US010273657B2

(12) United States Patent
Quan et al.

(10) Patent No.: US 10,273,657 B2
(45) Date of Patent: Apr. 30, 2019

(54) VARIABLE-SPEED VOLUME-CONTROL DIRECT-DRIVE ALL-ELECTRIC HYDRAULIC EXCAVATOR DRIVING AND ENERGY RECOVERY SYSTEM

(71) Applicant: TAIYUAN UNIVERSITY OF TECHNOLOGY, Taiyuan, Shanxi (CN)

(72) Inventors: Long Quan, Shanxi (CN); Huimin Hao, Shanxi (CN); Jiahai Huang, Shanxi (CN); Bing Wu, Shanxi (CN); Xiaohong Han, Shanxi (CN)

(73) Assignee: TAIYUAN UNIVERSITY OF TECHNOLOGY, Taiyuan, Shanxi (CN)

( * ) Notice: Subject to any disclaimer, the term of this patent is extended or adjusted under 35 U.S.C. 154(b) by 243 days.

(21) Appl. No.: 15/506,751

(22) PCT Filed: Oct. 20, 2014

(86) PCT No.: PCT/CN2014/088954
§ 371 (c)(1),
(2) Date: Sep. 15, 2017

(87) PCT Pub. No.: WO2016/041230
PCT Pub. Date: Mar. 24, 2016

(65) Prior Publication Data

US 2018/0023271 A1 Jan. 25, 2018

(30) Foreign Application Priority Data

Sep. 17, 2014 (CN) ..... 2014 1 0476502

(51) Int. Cl.
*F15B 21/14* (2006.01)
*F15B 1/04* (2006.01)
(Continued)

(52) U.S. Cl.
CPC ..... *E02F 9/22* (2013.01); *E02F 3/425* (2013.01); *E02F 9/02* (2013.01); *E02F 9/123* (2013.01);
(Continued)

(58) Field of Classification Search
CPC ..... F15B 11/17; F15B 11/006; F15B 2211/20515; F15B 2211/20576; F15B 21/08; F15B 12/14
(Continued)

(56) References Cited

U.S. PATENT DOCUMENTS 6,962,050 B2 * 11/2005 Hiraki ..... E02F 9/2217 60/414
8,910,474 B2 * 12/2014 Knussman ..... E02F 9/2242 60/421

* cited by examiner

*Primary Examiner* — F Daniel Lopez
*Assistant Examiner* — Daniel S Collins

(57) ABSTRACT

A variable-speed volume-control direct-drive all-electric hydraulic excavator drive and energy recover system the control drive circuit of which includes the A, B, C energy source, boom cylinder control valve group, arm cylinder control valve group, bucket control valve, swing control valve, swing motor control valve group, left travel control valve, right travel control valve, eight 2-position 2-way valve, I and II 2-position 3-way valve, I and II accumulator. The drive control circuit adopts open control independent-cavity variable-speed pump-control volume direct-drive circuit. Each of the cavities of cylinder is controlled by an energy source and the pressure and flow rate of the cavities are adjusted by the rotational speed and torque control of the generator independently. The present invention is four-quadrant running and have advantages of high efficiency, high integrity, low consumption, redundancy energy source, no need for pilot supply, low noise, integrate recovery of kinetic and potential energy.

4 Claims, 2 Drawing Sheets

(51) Int. Cl.

| | |
|---|---|
| ***E02F 9/22*** | (2006.01) |
| ***E02F 3/42*** | (2006.01) |
| ***E02F 9/02*** | (2006.01) |
| ***E02F 9/12*** | (2006.01) |
| ***E02F 9/20*** | (2006.01) |
| *F15B 11/16* | (2006.01) |
| *F15B 13/06* | (2006.01) |
| *F15B 21/08* | (2006.01) |
| *F15B 1/02* | (2006.01) |

(52) U.S. Cl.
CPC ..... *E02F 9/207* (2013.01); *E02F 9/2217* (2013.01); *E02F 9/2292* (2013.01); *F15B 21/14* (2013.01); *F15B 1/024* (2013.01); *F15B 1/04* (2013.01); *F15B 11/16* (2013.01); *F15B 13/06* (2013.01); *F15B 21/08* (2013.01); *F15B 2211/20515* (2013.01); *F15B 2211/20569* (2013.01); *F15B 2211/20576* (2013.01); *F15B 2211/30525* (2013.01); *F15B 2211/625* (2013.01); *F15B 2211/7051* (2013.01); *F15B 2211/7058* (2013.01); *F15B 2211/7135* (2013.01)

(58) Field of Classification Search
USPC ..... 60/417
See application file for complete search history.

VARIABLE-SPEED VOLUME-CONTROL DIRECT-DRIVE ALL-ELECTRIC HYDRAULIC EXCAVATOR DRIVING AND ENERGY RECOVERY SYSTEM

CROSS REFERENCE OF RELATED APPLICATION

This is a U.S. National Stage under 35 U.S.C. 371 of the International Application PCT/CN2014/088954, filed Oct. 20, 2014, which claims priority under 35 U.S.C. 119(a-d) to CN 201410476502.1, filed Sep. 17, 2014.

BACKGROUND OF THE PRESENT INVENTION

Field of Invention

The present invention relates to hydraulic system technical field, and more particularly to a variable-speed volume-control direct-drive all-electric hydraulic excavator driving and energy recovery system adopts distribution mutual redundancy electric control energy sources.

Description of Related Arts

With the remarkable development of engineering machinery, excavator has already become one of the pillar industries. How to effectively reduce the energy consumption of the hydraulic excavator in action has become an intermediate problem we are facing. The research on the energy recovery of the dynamic system, transmission system and hydraulic system is a key hot point in domestic and international engineering field.

Conventionally the energy source of hydraulic excavator mainly is internal combustion engine which drives the hydraulic pump and works with the control valve to realize the action of multiple hydraulic actuators. In order to reduce the energy loss of the hydraulic excavator load sensitive control and negative control is the most frequently adopted technology which has the disadvantage of increasing the energy consumption and heating due to the big throttle loss on the actuator with low load pressure; in order to improve the overall energy efficiency of the hydraulic excavator a hybrid energy technology appears which adopts hybrid energy source to control the running of generator. The hybrid energy technology improves the efficiency compared to the internal combustion engine while still has the problem of big throttle loss and discharge pollution.

All-electric drive is the direction of future development which is able to reduce energy loss, running cost and discharge pollution by combining the electric-control and hydraulic control. In 2005, Komatsu Ltd invented a pneumoelectric hydraulic excavator the boom, arm, bucket differential cylinder and swing device on the bus of which are controlled by eight dual-quantitative pump driven by four servo motor respectively based on the closed circuit theory (U.S. Pat. No. 6,962,050 B2). In 2007, Takeuchi MFG. Co., Ltd. realized the electric-driven of the hydraulic excavator with the strategy of single motor single pump, single motor dual-pump and dual-motor dual-pump (European patent EP 1985767 A1). In 2013, Hitachi Construction Machinery Co., Ltd. invent an all-electric hydraulic excavator which adopts five servo motor, four main pump and one slippage pump and combines the pump-control differential cylinder closed circuit and complex differential cylinder gap area compensate circuit to realized the boom, arm and swing drive and control (US 20130312399 A1); In 2013, Chinese patent CN 103255790 A published a mutual DC bus electric hydraulic excavator which adopts a combination of pump-control closed circuit and mutual DC bus to realize the all-electric drive and control for the boom and the arm. Due to the above mentioned electric-drive technology adopts the pump-control circuit to control the actuator the pump used must have at least two high pressure port, which increases the cost. At same time due to there is gap area between the two cavities of the hydraulic cylinder of the actuator the differential cylinder gap area compensate circuit to ensure the normal performance of the hydraulic cylinder of the actuator, which increases the throttle loss and the cost. When the actuator needs big power output the drive motor is not able to satisfy the requirement.

SUMMARY OF THE PRESENT INVENTION

An object of the present invention is to provide a variable-speed volume-control direct-drive all-electric hydraulic excavator drive and energy recovery system to solve the problems the conventional all-electric drive hydraulic excavator has, which adopts an open type control circuit, wherein each of the two cavities of the hydraulic cylinder is controlled by a energy source; the pressure and flow rate of every cavity is able to be adjusted independently by the control of the rotational speed and torque of the motor. The present invention is adapted to all kinds of asymmetry characters of the system and is four-quadrant running.

Accordingly, in order to accomplish the above object, the present invention provides a variable-speed volume-control direct-drive all-electric hydraulic excavator drive and energy recovery system, comprising: a boom hydraulic cylinder, an arm hydraulic cylinder, a bucket hydraulic cylinder, a swing motor, a left travel motor, a right travel motor, a mutual DC bus, a main switch, a rectifier, a smooth capacitor, a DC-DC converter, and a storage battery, wherein a drive control circuit is also included, comprising: an A energy source, a B energy source, a C energy source, a boom cylinder control valve group, an arm cylinder control valve, a swing motor control valve group, a bucket control valve, a swing control valve, a swing motor control valve group, a left travel control valve, a right travel control valve, a I-VIII 2-position 2-way valve, a I and II 2-position 3-way valve, a I and II accumulator; wherein the A, B, and C, energy source comprises a hydraulic pump, a motor generator, an inverter, an input of the inverter is connected with the mutual DC bus, an output of the inverter is connected with a motor generator driven by the inverter, the motor generator is connected with the hydraulic pump driven by the motor generator; wherein the control valve group of the boom cylinder, the arm cylinder and swing motor comprises A, B, C, D 2-position 2-way valve, wherein one of ports of A, D 2-position 2-way valve is connected to an oil tank respectively; the other port of A, D 2-position 2-way valve is connected to a first port of the B 2-position 2-way valve and C 2-position 2-way valve respectively; a second port of the B 2-position 2-way valve and C 2-position 2-way valve are connected together; an oil passage is drawn from a piping between the A and B 2-position 2-way valve to be connected with a rod cavity of the boom hydraulic cylinder, a rod cavity of arm hydraulic cylinder and a first port of the swing motor; wherein an oil passage is drawn from a piping between the C and D 2-position 2-way valve to be connected with a rodless cavity of the boom hydraulic cylinder, a rodless cavity of the arm hydraulic cylinder and a second port of the swing motor.

A first working port of the hydraulic pump of the A energy source is connected with a first port of the I 2-position 3-way valve; a second port and a third port are connected with the I accumulator and the tank respectively; a second working port of the hydraulic pump of A energy source is connected with a first port of the left travel control valve, a first port of the bucket control valve, a piping between the B 2-position 2-way valve and C 2-position 2-way valve of the boom cylinder control valve group, a first port of the IV 2-position 2-way valve and a first port of the V 2-position 2-way valve.

An inlet port of the hydraulic pump of the B energy source is connected with the tank, an oil outlet of which is connected with a second port of the V 2-position 2-way valve; wherein an oil outlet of the hydraulic pump of the B energy source is connected with a piping between the B and C 2-position 2-way valve of the bucket control valve group and swing motor control valve group respectively, a first port of the right travel control valve, and a first port of the VI 2-position 2-way valve; the oil outlet of the hydraulic pump of the B energy source is connected with the II accumulator through the VII 2-position 2-way valve.

A first working port of the hydraulic pump of the C energy source is connected with a first port of the II 2-position 3-way valve, wherein a second and a third port is connected with the II accumulator and the tank; a second working port of the hydraulic pump of the C energy source is connected with a second port of VI 2-position 2-way valve, a second port of the I and II 2-position 2-way valve, and a first port of swing control valve; wherein a second working port of the hydraulic pump of the C energy source is connected with the II accumulator and a second working port of the hydraulic pump of the A energy source through the VIII 2-position 2-way valve and the IV 2-position 2-way valve; a first port of the I 2-position 2-way valve and the II 2-position 2-way valve are connected with the rod cavity of the boom hydraulic cylinder and the arm hydraulic cylinder respectively.

A second and a third port of the swing control valve are connected with two ports of the swing motor respectively; working ports of the left travel motor and the right travel motor are connected with the left travel control valve and right travel control valve respectively; a first working port of the III 2-position 2-way valve is connected with the rodless cavity of the arm hydraulic cylinder; a second working port of the III 2-position 2-way valve is connected with a first working port of the II 2-position 2-way valve.

The control circuits of the boom hydraulic cylinder, arm hydraulic cylinder and swing motor are all independent-cavity variable-speed pump-control volume direct-drive circuit; the A energy source feeds oil to the left travel motor, the bucket hydraulic cylinder and boom hydraulic cylinder; the B energy source feeds oil to the arm hydraulic cylinder, the swing motor and the right travel motor; the C energy source feeds oil to the left travel motor, bucket hydraulic cylinder, boom hydraulic cylinder, arm hydraulic cylinder, swing motor and right travel motor by on/off control of the IV, V and VI 2-position 2-way valve.

A redundancy control of the A, B and C energy source is that the rod cavity and rodless cavity of the boom hydraulic cylinder is controlled by the A energy source or the C energy source or the combination of the A and C energy source and the B energy source or the C energy source or the combination of the B and C energy source respectively, the rod cavity and rodless cavity of the arm hydraulic cylinder is controlled by the B energy source or the C energy source or the combination of the B and C energy source and the B energy source or the C energy source or the combination of the B and C energy source respectively, and the oil is able to pass through the rod cavity and rodless cavity of the arm hydraulic cylinder by the on/off control of the III 2-position 2-way valve.

Control circuits of the boom hydraulic cylinder, arm hydraulic cylinder and swing motor are active and passive composite energy recovery circuit, wherein when the pressure inside the I and II accumulator is lower than the pre-set minimal value the potential energy of the boom hydraulic cylinder and arm hydraulic cylinder and the kinetic energy of the swing motor braking is stored in the I or II accumulator by connecting the IV-VIII 2-position 2-way valve; when the pressure inside the I and II accumulator is higher than the pre-set maximum value the potential energy of the boom hydraulic cylinder and arm hydraulic cylinder and the kinetic energy of the swing motor braking is stored in the mutual DC bus as electric energy transferred by the motor generator; the energy storage in the I or II accumulator and mutual DC bus is able to be carried out simultaneously; wherein the passage and transfer of system energy between the accumulator, mutual DC bus and motor generator is able to drive a load by control the A, B and C energy source.

A redundancy control of the energy recovery of the A, B and C energy source is when the motor generator is recover the energy as a generator the A, B and C energy source is able to work separately or in combination to recover the potential energy of the boom hydraulic cylinder and arm hydraulic cylinder and the kinetic energy of the swing motor braking.

The hydraulic pumps of the A, B, C energy source are a fixed hydraulic pump or different kinds of variable hydraulic pump; the motor generators of the A, B and C energy source are a permanent magnet synchronous generator or a asynchronous AC generator or a switched reluctance generator.

The A, B, C and D 2-position 2-way valve of the boom cylinder control valve group, arm cylinder control valve group and swing motor control valve group, the bucket control valve, swing control valve, left travel control valve, right travel control valve, the I-VIII 2-position 2-way valve the I and II 2-position 3-way valve is electromagnetic switched valve and electric proportional valve or a valve group of cartridge valve.

The A, B, C and D 2-position 2-way valve of the boom cylinder control valve group, arm cylinder control valve group and swing motor control valve group are replaceable by a combination of 3-position 3-way valves which with a same function.

The present invention has the below benefits:

1) The system is four-quadrant running: each of the two cavities of cylinder is controlled by an energy source respectively and the pressure and flow rate of the cavities are adjusted by the rotational speed and torque control of the generator independently, which is adapted to all kinds of asymmetry characters of the system and is four-quadrant running and satisfies the requirements of all kinds of loads.
2) High efficiency: the present invention adopts the theory of distribution variable-speed pump independent inlet and outlet port direct-drive differential cylinder circuit and the control technology of active and passive composite swing, which is able to eliminate throttle loss. Compared to the collective energy source drive variable pump, every motor and fixed hydraulic pump works within the high efficiency zone, which improves the overall efficiency significantly.
3) High integrity: the layout overall control plan of the present invention is flexible, convenient, highly integrated, and free of the limitation by space.

4) Low consumption: the overall control plan of the present invention reduces the installing power and the system heating and increases the sustainable working time while reducing the cooling power, which solve the problem of hydraulic oil heating and aging due to small hydraulic oil tank of the engineering machinery.
5) Energy source redundancy: the overall control plan of the present invention has redundancy function which is able to shut off the mal-function energy source and ensures the stable performance of the actuator while the energy source failure.
6) The control plan of the present invention adopts open type working while remains the advantages of the closed circuit, which has many advantages such as no need for pilot supply, low noise, integrate recovery of kinetic energy and potential energy etc. and makes up the disadvantages of the closed control.

Element reference: 1—boom hydraulic cylinder 1—arm hydraulic cylinder, 3—bucket hydraulic cylinder, 4—swing motor, 5—left travel motor, 6—right travel motor, 7—mutual DC bus, 8—main switch, 9—rectifier, 10—smooth capacitor, 11—DC-DC converter, 12—storage battery, 13—A energy source, 14—B energy source, 15—C energy source, 16—boom cylinder control valve group, 17—arm cylinder control valve, 18—swing motor control valve group, 20—bucket control valve, 21—swing control valve, 22—left travel control valve, 23—right travel control valve, 24~31—I-VIII 2-position 2-way valve, 32—I 2-position 3-way valve, 33—II 2-position 3-way valve, 34—I accumulator, 35—II accumulator, 38—inverter, 39—motor generator, 40—hydraulic pump, 41—actuator, 42—motor controller, 43—control system.

DETAILED DESCRIPTION OF THE PREFERRED EMBODIMENT

Figure 1:
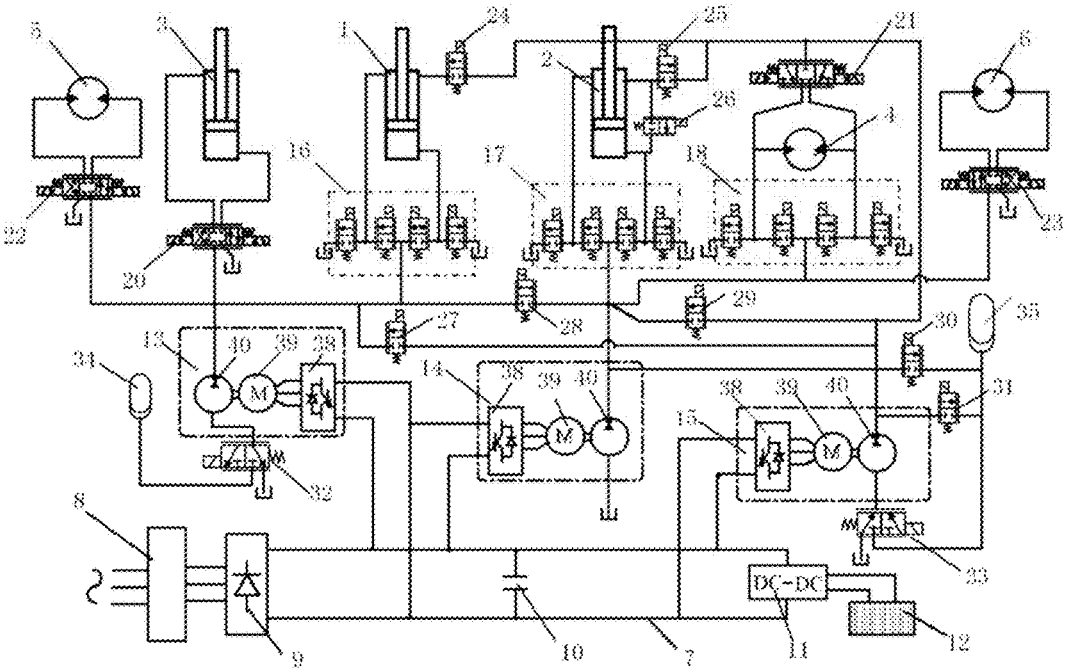
FIG. 1 illustrates a system of the present invention.

Referring to FIG. 1 to FIG. 4 of the drawings, according to a preferred embodiment of the present invention is illustrated, wherein as illustrated in FIG. 1 a variable-speed volume-control direct-drive all-electric hydraulic excavator drive and energy recovery system, comprising: a boom hydraulic cylinder 1, an arm hydraulic cylinder 2, a bucket hydraulic cylinder 3, a swing motor 4, a left travel motor 5, a right travel motor 6, a mutual DC bus 7, a main switch 8, a rectifier 9, a smooth capacitor 10, DC-DC converter 11, and a storage battery 12, wherein a drive control circuit is also included, comprising: an A energy source 13, a B energy source 14, a C energy source 15, a boom cylinder control valve group 16, an arm cylinder control valve 17, a swing motor control valve group 18, a bucket control valve 20, a swing control valve 21, a left travel control valve 22, a right travel control valve 23, I-VIII 2-position 2-way valves 24~31, I and II 2-position 3-way valves 32,33, I and II accumulators 34,35; wherein each of the A, B and C energy source comprises a hydraulic pump 40, a motor generator 39, an inverter 38, an input of the inverter is connected to the mutual DC bus, an output of the inverter is connected to a motor generator driving the inverter, the motor generator is connected with the hydraulic pump driven by the motor generator.

Figure 2:
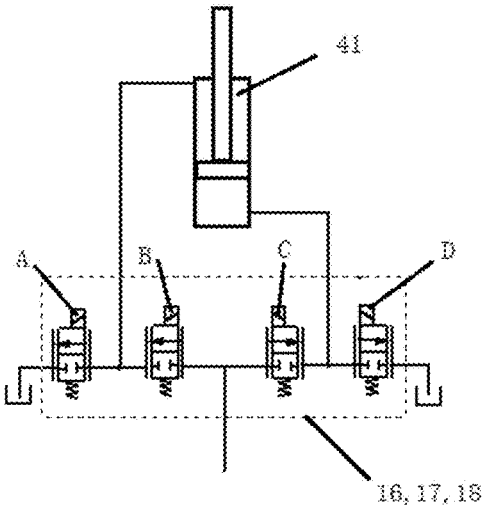
FIG. 2 is an assembly of a boom cylinder control valve group, arm cylinder control valve group and swing motor control valve group of the present invention.

As illustrated in FIG. 1 and FIG. 2 the control valve group of the boom cylinder, the arm cylinder and swing motor comprises A, B, C, D 2-position 2-way valve, wherein the first ports of A, D 2-position 2-way valve are connected to an oil tank respectively; the second ports of A, D 2-position 2-way valve are connected to the first port of B 2-position 2-way valve and the first port of the C 2-position 2-way valve respectively; the second port of the B 2-position 2-way valve and the second port of the C 2-position 2-way valve are connected together; a oil passage is drawn from a piping between the A and the B 2-position 2-way valve to be connected with a rod cavity of the boom hydraulic cylinder, a rod cavity of the arm hydraulic cylinder and a first port of the swing motor; wherein another oil passage is drawn from a piping between the C and the D 2-position 2-way valve to be connected with a rodless cavity of the boom hydraulic cylinder, a rodless cavity of the arm hydraulic cylinder and a second port of the swing motor.

A first working port of the hydraulic pump of the A energy source is connected with a first port of the I 2-position 3-way valve; a second and a third port of the I 2-position 3-way valve are connected with the I accumulator and the tank respectively; a second working port of the hydraulic pump of the A energy source is connected with a first port of the left travel control valve, a first port of the bucket control valve, a piping between the B 2-position 2-way valve and the C 2-position 2-way valve of the boom cylinder control valve group, a first port of the IV 2-position 2-way valve and a first port of the V 2-position 2-way valve.

An inlet port of the hydraulic pump of the B energy source is connected with the tank, an outlet of which is connected with a second port of the V 2-position 2-way valve; wherein an outlet of the hydraulic pump of the B energy source is connected with a piping between the B and C 2-position 2-way valve of the bucket control valve group and swing motor control valve group respectively, a first port of the right travel control valve, and a first port of the VI 2-position 2-way valve; the outlet of the hydraulic pump of the B energy source is connected with the II accumulator through the VII 2-position 2-way valve.

A first working port of the hydraulic pump of the C energy source is connected with a first port of the II 2-position 3-way valve, wherein a second and a third port is connected with the II accumulator and the tank respectively; a second working port of the hydraulic pump of the C energy source is connected with a second port of VI 2-position 2-way valve, a second port of the I and II 2-position 2-way valve, and a first port of swing control valve; wherein a second working port of the hydraulic pump of the C energy source is connected with the II accumulator and a second working port of the hydraulic pump of the A energy source through the VIII 2-position 2-way valve and the IV 2-position 2-way valve respectively; a first port of the I 2-position 2-way valve and the II 2-position 2-way valve are connected with the rod cavity of the boom hydraulic cylinder and the arm hydraulic cylinder respectively.

A second and a third port of the swing control valve are connected with two ports of the swing motor respectively; working ports of the left travel motor and the right travel motor are connected with the left travel control valve and right travel control valve respectively; a first working port of the III 2-position 2-way valve is connected with the rodless cavity of the arm hydraulic cylinder; a second working port of the III 2-position 2-way valve is connected with a first working port of the II 2-position 2-way valve.

Control circuits of the boom hydraulic cylinder, arm hydraulic cylinder and swing motor are all independent-cavity variable-speed pump-control volume direct-drive circuit; the A energy source feeds oil to the left travel motor, the bucket hydraulic cylinder and boom hydraulic cylinder; the B energy source feeds oil to the arm hydraulic cylinder, the swing motor and the right travel motor; the C energy source feeds oil to the left travel motor, bucket hydraulic cylinder, boom hydraulic cylinder, arm hydraulic cylinder, swing motor and right travel motor by on/off control of the IV, V and VI 2-position 2-way valve.

A redundancy control of the A, B and C energy source is that the rod cavity and rodless cavity of the boom hydraulic cylinder is controlled by the A energy source or the C energy source or the combination of the A and C energy source and the B energy source or the C energy source or the combination of the B and C energy source respectively, the rod cavity and rodless cavity of the arm hydraulic cylinder is controlled by the B energy source or the C energy source or the combination of the B and C energy source and the B energy source or the C energy source or the combination of the B and C energy source respectively, and the oil is able to pass through the rod cavity and rodless cavity of the arm hydraulic cylinder by the on/off control of the III 2-position 2-way valve.

Figure 3:
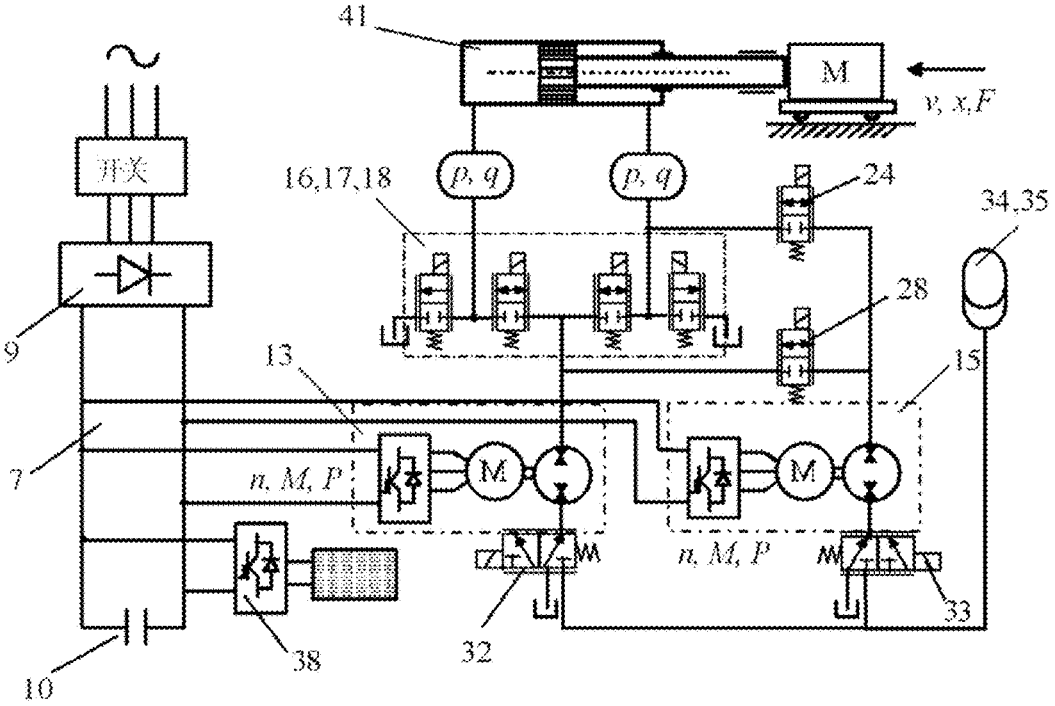
FIG. 3 illustrates a servo system circuit of independent-cavity variable-speed volume direct-drive differential cylinder of the present invention.

As illustrated in FIG. 3 the theory for independent-cavity variable-speed pump-control volume direct-drive circuit to drive the boom, arm and swing motor is that the actuator 41 may be the boom hydraulic cylinder or arm hydraulic cylinder, or the swing motor. The actuator drives load M. The rod cavity and rodless cavity of the boom hydraulic cylinder or the arm hydraulic cylinder, and the two ports of the swing motor are controlled and driven by A energy source 13 and B energy source 14. The A, B energy source is able to feed oil to the two cavities of the hydraulic cylinder or the two ports of the swing motor independently or together according to the requirement of the load by on/off control of the I 2-position 2-way valve 24 and the V 2-position 2-way valve 28. For example when the A energy source feed oil independently, the B and D 2-position 2-way valve of the boom cylinder control valve group (or the arm cylinder control valve group or the swing motor control valve) is in on-state. The A energy source input the oil to the rodless cavity of the actuator through the B 2-position 2-way valve of the boom cylinder control valve group (or the arm cylinder control valve group or the swing motor control valve). The oil in the rod cavity flows back to the tank through the D 2-position 2-way valve of the boom cylinder control valve group (or the arm cylinder control valve group or the swing motor control valve). When the A and B energy source feed the oil together, the V 2-position 2-way valve 28 is in on-state. The A and B energy source input the oil to the rodless cavity of the actuator. The oil in the rod cavity flows back to the tank through the D 2-position 2-way valve of the boom cylinder control valve group (or the arm cylinder control valve group or the swing motor control valve). The A and B energy source are both connected with the mutual DC bus. As illustrated in FIG. 3 the rod cavity and rodless cavity of the hydraulic cylinder or the two ports of the swing motor are controlled independently, the pressure and flow rate of all the cavities of the actuator are able to be adjusted separately by controlling the rotational speed and torque of the motor, which meets the requirements of all kinds of system with asymmetry character and realize four-quadrant running.

The theory illustrated in FIG. 3 is applied to hydraulic excavator. The boom hydraulic cylinder, arm hydraulic cylinder, swing motor, left travel motor, right travel motor and bucket hydraulic cylinder are driven by A, B and C energy source. Under normal state, wherein the A energy source feeds oil to the left travel motor, the bucket hydraulic cylinder and the boom hydraulic cylinder; the B energy source feeds oil to the arm hydraulic cylinder, the swing motor and the right travel motor; when strong driven force is needed by the load, C energy source feeds oil to the actuator as a complement according to the requirements by on/off control of the IV 2-position 2-way valve 27, the V 2-position 2-way valve 28 and the VI 2-position 2-way valve 29; the rod cavity and to rodless cavity of the boom hydraulic cylinder and arm hydraulic cylinder and two working ports of the swing motor are controlled by two energy source respectively. The distributed A, B and C energy source are all connected with the mutual DC bus. The control valves in the circuit make the A, B and C energy source to be redundant system to each other. The A, B and C energy source is able to drive the actuator independently or in arbitrary combination, which makes the actuators act separately or in combination. If any of the three energy sources fail to work, the mal-function energy source is able to be separated by the control valves in the circuit and the normal working energy source will be set in working mode. The system is able to working normally if there is energy source malfunction.

As illustrated in FIG. 1, the variable-speed volume-control direct-drive all-electric hydraulic excavator drive system has energy recovery function which constitutes independent-cavity variable-speed volume-control all-electric hydraulic excavator energy recovery system. The control circuits of the boom hydraulic cylinder, arm hydraulic cylinder and swing motor are active and passive composite energy recovery circuit, wherein when the pressure inside the I and II accumulator is lower than the pre-set minimal value the potential energy of the boom hydraulic cylinder and arm hydraulic cylinder and the kinetic energy of the swing motor braking is stored in the I or II accumulator by connecting the IV-VIII 2-position 2-way valve; when the pressure inside the I and II accumulator is higher than the pre-set maximum value the potential energy of the boom hydraulic cylinder and arm hydraulic cylinder and the kinetic energy of the swing motor braking is stored in the mutual DC bus as electric energy transferred by the motor generator; the energy storage in the I or II accumulator and mutual DC bus is able to be carried out simultaneously; wherein the system energy is past and transferred between the accumulator, the mutual DC bus and the motor generator, which is able to drive a load by control the A, the B and the C energy source A redundancy control of the energy recovery of the A, B and C energy source is when the motor generator is recover the energy as a generator the A, B and C energy source is able to work separately or in combination to recover the potential energy of the boom hydraulic cylinder and arm hydraulic cylinder and the kinetic energy of the swing motor braking.

Figure 4:
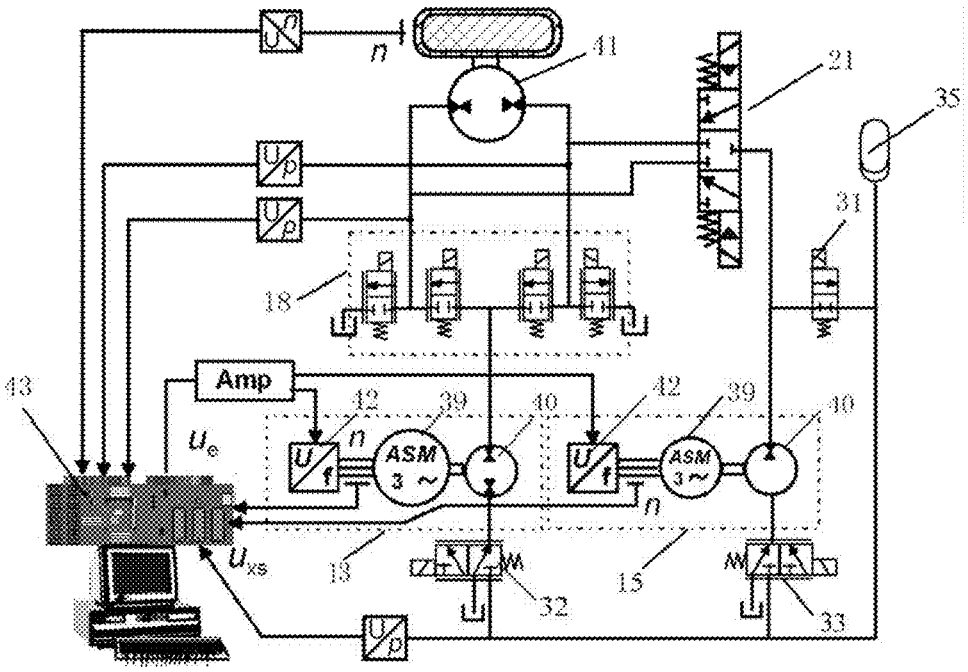
FIG. 4 illustrates the active and passive composite energy recovery circuit.

The theory of active and passive composite energy recovery circuit for recovering the potential energy of the boom and arm hydraulic cylinder and the kinetic energy of swing motor braking is illustrated in FIG. 4. The actuator 41 may be the boom hydraulic cylinder or arm hydraulic cylinder or the swing motor, which drives the load M. The A energy source 13 and the B energy source 14 both comprises motor controller 42, motor generator 39 and hydraulic pump 38. The input terminal of the motor controller is connected with the control system 43 and the output terminal of the motor controller is connected with motor generator driven by the motor controller. The motor generator is connected with the hydraulic pump driven by the motor generator.

For example when the actuator is the swing motor and the active circuit is the drive circuit. A and B energy source feed oil to the two ports of the swing motor independently or together according to the load requirements by on/off control of the swing motor control valve group and the swing control valve. The passive circuit is energy recovery circuit. By on/off control of the swing control valve and the VIII 2-position 2-way valve 31, the motor braking kinetic energy is stored in the II accumulator 35. All the control valves, A energy source and B energy source is controlled by the control system 43. The energy stored in the accumulator II is able to be released as auxiliary drive for the system.

The active and passive composite swing drive theory illustrated in FIG. 4 is applied to hydraulic excavator. The A, B and C energy source drive the actuators, all three of which is connected with the mutual DC bus and constitute the independent-cavity variable-speed volume direct-drive all-electric hydraulic excavator energy recovery system. The A, B and C energy source is able to drive the boom hydraulic cylinder, the arm hydraulic cylinder, the swing motor, the left travel motor, the right travel motor and the bucket hydraulic cylinder while the potential energy of the boom hydraulic cylinder and arm hydraulic cylinder and the kinetic energy of the swing motor braking are able to be recovered. When the pressure inside the I and II accumulator is low, the potential energy of the boom hydraulic cylinder and arm hydraulic cylinder and the kinetic energy of the swing motor braking are able to be stored in the I or II accumulator by connecting the IV-VIII 2-position 2-way valve. When the pressure inside the I and II accumulator is too high to store energy, the potential energy of the boom hydraulic cylinder and arm hydraulic cylinder and the kinetic energy of the swing motor braking are able to be stored in the mutual DC bus as electric energy transferred by the motor generator.

The motor generator is able to work as a motor and a generator according to the different requirement of the load. The motor generator works as a motor when drive the load and a generator when recovery the energy. The system energy is passed and transferred among the accumulator, mutual DC bus and motor generator without the need to add specific energy storage components.

The hydraulic pumps of the A, B, and C energy source are fixed hydraulic pumps or different kinds of variable hydraulic pumps; the motor generators of the A, B and C energy source are permanent magnet synchronous generators or asynchronous AC generators or switched reluctance generators.

The A, B, C and D 2-position 2-way valve of the boom cylinder control valve group, arm cylinder control valve group and swing motor control valve group, the bucket control valve, swing control valve, left travel control valve, right travel control valve, the I-VIII 2-position 2-way valve the I and II 2-position 3-way valve are electromagnetic switched valve and electric proportional valves or valve groups of cartridge valves.

The A, B, C and D 2-position 2-way valve of the boom cylinder control valve group, arm cylinder control valve group and swing motor control valve group are replaceable by a combination of 3-position 3-way valves with a same function.

What is claimed is:

1. A variable-speed volume-control direct-drive all-electric hydraulic excavator driving and energy recovery system, comprising: a boom hydraulic cylinder (1), an arm hydraulic cylinder (2), a bucket hydraulic cylinder (3), a swing motor (4), a left travel motor (5), a right travel motor (6), a mutual DC bus (7), a main switch (8), a rectifier (9), a smooth capacitor (10), a DC-DC converter (11), and a storage battery (12), wherein a drive control circuit is also included, comprising: an A energy source (13), a B energy source (14), a C energy source (15), a boom cylinder control valve group (16), an arm cylinder control valve (17), a swing motor control valve group (18), a bucket control valve (20), a swing control valve (21), a left travel control valve (22), a right travel control valve (23), I-VIII 2-position 2-way valves (24~31), I and II 2-position 3-way valves (32,33), I and II accumulators (34,35); wherein each of the A, the B, and the C energy sources comprises a hydraulic pump (40), a motor generator (39), an inverter (38), an input of the inverter is connected to the mutual DC bus, an output of the inverter is connected to a motor generator driving the inverter, the motor generator is connected with the hydraulic pump driven by the motor generator; wherein the control valve group of the boom cylinder, the arm cylinder and the swing motor comprises of A, B, C, D 2-position 2-way valves, wherein first ports of A, D 2-position 2-way valve are connected to an oil tank respectively; second ports of A, D 2-position 2-way valve are connected to a first port of the B 2-position 2-way valve and a first port of the C 2-position 2-way valve respectively; a second port of the B 2-position 2-way valve and a second port of the C 2-position 2-way valve are connected together; a oil passage is drawn from a piping between the A and the B 2-position 2-way valve to be connected with a rod cavity of the boom hydraulic cylinder, a rod cavity of the arm hydraulic cylinder and a first port of the swing motor; wherein another oil passage is drawn from a piping between the C and the D 2-position 2-way valve to be connected with a rodless cavity of the boom hydraulic cylinder, a rodless cavity of the arm hydraulic cylinder and a second port of the swing motor;

wherein a first working port of the hydraulic pump of the A energy source is connected with a first port of the I 2-position 3-way valve; a second port and a third port of the I 2-position 3-way valve are connected with the I accumulator and the tank respectively; a second working port of the hydraulic pump of the A energy source is connected with a first port of the left travel control valve, a first port of the bucket control valve, a piping between the B 2-position 2-way valve and the C 2-position 2-way valve of the boom cylinder control valve group, a first port of the IV 2-position 2-way valve and a first port of the V 2-position 2-way valve;

wherein an inlet of the hydraulic pump of the B energy source is connected with the tank, an outlet of which is connected with a second port of the V 2-position 2-way valve; wherein an outlet of the hydraulic pump of the B energy source is connected with a piping between the B and C 2-position 2-way valve of the bucket control valve group and swing motor control valve group, a first port of the right travel control valve, and a first port of the VI 2-position 2-way valve; the outlet of the hydraulic pump of the B energy source is connected with the II accumulator through the VII 2-position 2-way valve;

wherein a first working port of the hydraulic pump of the C energy source is connected with a first port of the II 2-position 3-way valve, wherein a second and a third port is connected with the II accumulator and the tank respectively; a second working port of the hydraulic pump of the C energy source is connected with a second port of the VI 2-position 2-way valve, a second port of the I and the II 2-position 2-way valve, and a first port of swing control valve; wherein a second working port of the hydraulic pump of the C energy source is connected with the II accumulator and a second working port of the hydraulic pump of the A energy source through the VIII 2-position 2-way valve and the IV 2-position 2-way valve respectively; a first port of the I 2-position 2-way valve and the II 2-position 2-way valve are connected with the rod cavity of the boom hydraulic cylinder and the arm hydraulic cylinder respectively;

wherein a second port and a third port of the swing control valve are connected with two ports of the swing motor respectively; working ports of the left travel motor and the right travel motor are connected with the left travel control valve and the right travel control valve respectively; a first working port of the III 2-position 2-way valve is connected with the rodless cavity of the arm hydraulic cylinder; a second working port of the III 2-position 2-way valve is connected with a first working port of the II 2-position 2-way valve;

wherein control circuits of the boom hydraulic cylinder, the arm hydraulic cylinder and swing motor are all independent-cavity variable-speed pump-control volume direct-drive circuits; the A energy source feeds oil to the left travel motor, the bucket hydraulic cylinder and the boom hydraulic cylinder; the B energy source feeds oil to the arm hydraulic cylinder, the swing motor and the right travel motor; the C energy source feeds oil to the left travel motor, the bucket hydraulic cylinder, the boom hydraulic cylinder, the arm hydraulic cylinder, the swing motor and the right travel motor by on/off control of the IV, V and VI 2-position 2-way valves;

wherein a redundancy control of the A, the B and the C energy source is that the rod cavity and the rodless cavity of the boom hydraulic cylinder are controlled by the A energy source or the C energy source or the combination of the A and the C energy source and the B energy source or the C energy source or the combination of the B and the C energy source respectively, the rod cavity and the rodless cavity of the arm hydraulic cylinder are controlled by the B energy source or the C energy source or the combination of the B and the C energy source and the B energy source or the C energy source or the combination of the B and the C energy source respectively, and the oil is able to pass through the rod cavity and the rodless cavity of the arm hydraulic cylinder by the on/off control of the III 2-position 2-way valve;

wherein control circuits of the boom hydraulic cylinder, the arm hydraulic cylinder and the swing motor are active and passive composite energy recovery circuits, wherein when the pressure inside the I and the II accumulator is lower than the pre-set minimal value, potential energy of the boom hydraulic cylinder and the arm hydraulic cylinder and kinetic energy of the swing motor braking is stored in the I or the II accumulator by connecting the IV-VIII 2-position 2-way valves; when the pressure inside the I and the II accumulators is higher than the pre-set maximum value, the potential energy of the boom hydraulic cylinder and the arm hydraulic cylinder and the kinetic energy of the swing motor braking is stored in the mutual DC bus as electric energy transferred by the motor generator; the energy storage in the I or the II accumulators and DC bus is able to be carried out simultaneously; wherein the system energy is past and transferred between the accumulator, the mutual DC bus and the motor generator, which is able to drive a load by control the A, the B and the C energy source;

wherein a redundancy control of the energy recovery of the A, the B and the C energy source is when the motor generator is recover the energy as a generator the A, the B and the C energy source is able to work separately or in combination to recover the potential energy of the boom hydraulic cylinder and the arm hydraulic cylinder and the kinetic energy of the swing motor braking.

2. The variable-speed volume-control direct-drive all-electric hydraulic excavator drive and energy recovery system, as recited in claim 1, wherein the hydraulic pumps of the A, B and C energy source are fixed hydraulic pumps or different kinds of variable hydraulic pumps; the motor generators of the A, B and C energy source are permanent magnet synchronous generators, asynchronous AC generators or switched reluctance generators.

3. The variable-speed volume-control direct-drive all-electric hydraulic excavator drive and energy recovery system, as recited in claim 1, wherein the A, the B, the C and the D 2-position 2-way valves of the boom cylinder control valve group, the arm cylinder control valve group and the swing motor control valve group, the bucket control valve, the swing control valve, the left travel control valve, the right travel control valve, the I-VIII 2-position 2-way valve the I and II 2-position 3-way valve are electromagnetic switched valves and electric proportional valves or valve groups of cartridge valves.

4. The variable-speed volume-control direct-drive all-electric hydraulic excavator drive and energy recovery system, as recited in claim 1, wherein the A, the B, the C and the D 2-position 2-way valves of the boom cylinder control valve group, the arm cylinder control valve group and the swing motor control valve group are replaceable by a combination of 3-position 3-way valves with a same function.

* * * * *